US005149300A

United States Patent [19]

Barrett

[11] Patent Number: 5,149,300

[45] Date of Patent: Sep. 22, 1992

[54] METHOD OF CONSTRUCTION OF PRE-BALANCED AIR HANDLING SYSTEM

[76] Inventor: Michael R. Barrett, 14 N. Ridge Rd., Greenbelt, Md. 20770

[21] Appl. No.: 697,617

[22] Filed: May 9, 1991

[51] Int. Cl.[5] ..... F24F 7/06

[52] U.S. Cl. ..... 454/338; 454/232

[58] Field of Search ..... 98/34.1; 236/49.1, 49.3; 454/232, 338

[56] References Cited

U.S. PATENT DOCUMENTS 2,160,132 5/1939 Durst ..... 454/232
2,801,581 8/1957 Springhorn ..... 454/232
4,406,397 9/1983 Kamata et al. ..... 236/49.3

*Primary Examiner*—Harold Joyce

[57] ABSTRACT

An air handling duct system is provided wherein downstream duct segments are downsized proportionately relative to a immediate upstream duct segments including lateral outlets in order to maintain design air volumes in the upstream and downstream duct segments, wherein downstream duct legs of angular turns are proportionately up sized relative to upstream duct legs of the angular turns in order to prevent increases in flow resistance in the duct system as a result of the turns and wherein lateral branch duct runs are proportionately sized relative to established air flow volumes immediately upstream from said branch ducts and the flow volumes in the upstream ends of said branch duct runs.

5 Claims, 1 Drawing Sheet

METHOD OF CONSTRUCTION OF PRE-BALANCED AIR HANDLING SYSTEM

BACKGROUND OF THE INVENTION

1. Field of the Invention

This invention relates to a method by which an air handling duct system may be designed and constructed so as to be substantially fully "pre-balanced" and thus eliminate or substantially reduce the necessity for a technician to test and make modifications to the duct system after construction thereof in order to obtain substantially the correct air flow discharges at the various air outlets thereof.

2. Description of Related Art

Various different forms air handling duct systems heretofore have been provided and angular turns in air handling systems have been equipped with turning vanes to reduce resistance to air flow at angular turns of the duct system. In addition, downstream legs of air supply duct systems are conventionally provided with extractors and adjustable dampers, after construction of air handling duct systems, in order to obtain proper "balance" of the duct system so that the various air outlets thereof will discharge the designed air flow volumes. Of course, the addition of extractors and/or dampers increases the overall resistance to the flow of air through the duct system and, accordingly, the operational speed of the associated fan must be increased or the fan must be replaced with a more powerful motor or motor and fan assembly of a larger capacity, all of which modifications made to a pre-designed air handling duct system in order to balance the same result in considerable expense.

In addition, if it does become necessary to replace a pre-determined fan with a more powerful larger capacity fan or motor due the necessity of adding extractors and dampers to the designed air handling system, further balancing of the system may be required after the upgrade of the motor or motor and fan assembly thereof, inasmuch as the upgraded assembly may have different performance curves as to static pressure and volumetric discharge. This further increases the cost of "balancing" an air delivery duct system to fall within the usual plus or minus 5 or 10 percent (as required by the system design) of the designed air volume discharge at each of the outlets of the duct system.

SUMMARY OF THE INVENTION

The method of the instant invention utilizes formulae for making angular turns in air duct systems which may be applied to any included angular turn between 90 and 180 degrees in order to effect the desired angular turn without an increase of static resistance upstream from the turn due to the existence of the turn and other than the static resistance increase which occurs through a duct run of a given size and given length.

The method of the instant invention also incorporates a method of designing the size of a branch run relative to a main duct run from which the branch run receives air according to the length of the branch run in relation to its position along the longest main run of the duct system and the length of the branch run plus the length of the main duct run from the inlet end thereof to the branch duct run in relation to the overall length of the superimposed longest main duct run.

The main object of this invention is to provide a method of designing an air handling duct system including a main duct run and branch duct runs wherein the main duct run may or may not include angular turns and wherein the inlet end of the branch duct run is disposed at an angle to the main duct run, at its intersection therewith, and further wherein the air outlets of the various runs will be fully balanced (substantially within plus or minus 5 or 10 percent) upon completion of installation of the duct system with the proper fan selection according to the instant invention.

Yet another important object of this invention is provide a method of designing an air handling duct system in accordance with the preceding object and which will not require the subsequent addition of turning vanes, extractors and/or dampers in order to provide a substantially full balanced duct system subsequent to its construction.

A further object of this invention is to provide a method of constructing an air handling duct system which may accommodate a wide range of air volume capacities and resistance to be added to the air handling duct system adjacent the inlet end thereof in the form of heat exchangers and/or air filters, etc.

Another important object of this invention is to provide a method of constructing an air handling duct system which will allow the duct system to perform as designed with minimum usage of electrical energy by the properly selected motorized fan assembly thereof.

Yet another important object of this invention is to provide an air handling duct system which is "balanced" and efficient in moving air therethrough so as to reduce the noise/vibration generated by air flow through the air handling duct system when the latter is in operation.

A further object of this invention is to provide an air handling duct system in which the resistance to air flow therethrough is maintained at a minimum.

Yet another object of this invention is to provide a method of constructing a "balanced" air handling duct system which may be carried out in a minimal amount of time and with a minimal amount of wasted materials.

Another very important object of this invention is to provide a method of constructing a "balanced" air handling duct system which will at least substantially eliminate the need for subsequent "balancing" of the duct system involving considerable time and material expenses.

A final object of this invention to be specifically enumerated herein is to provide a method of constructing a "balanced" air handling duct system in accordance with the preceding objects and will enable the duct system to be constructed through the utilization of conventional duct system constructing practices.

These together with other objects and advantages which will become subsequently apparent reside in the details of construction and operation as more fully hereinafter described and claimed, reference being had to the accompanying drawing forming a part hereof, wherein like numerals refer to like parts throughout.

DETAILED DESCRIPTION OF THE INVENTION

Figure 1:
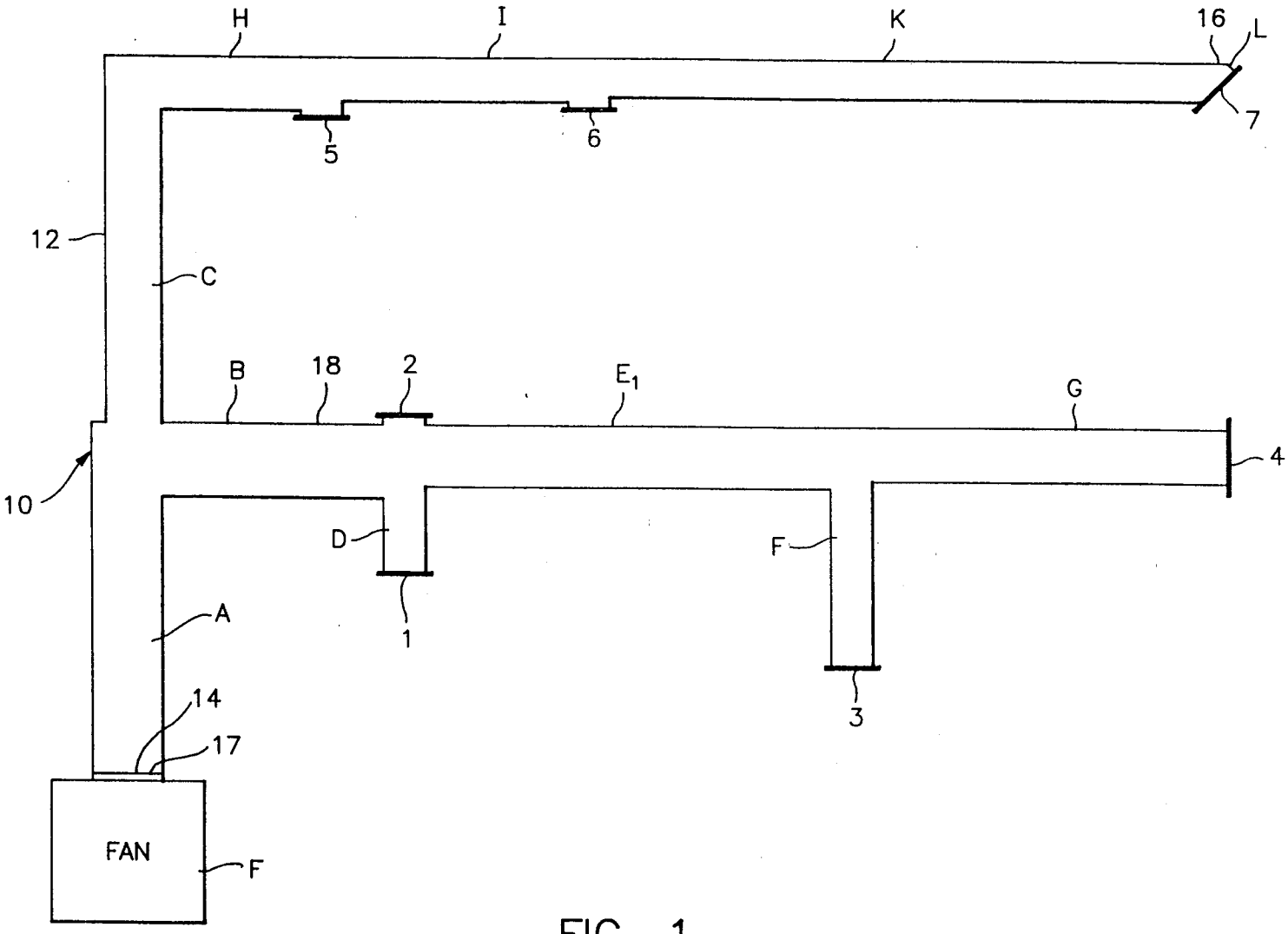
FIG. 1 is a schematic plan view of a typical air handling duct system constructed in accordance with the present invention and wherein the duct system includes a main duct run incorporating a 90 degree turn centrally intermediate its inlet and outlet ends as well as a branch duct run disposed at substantially 90 degrees relative to the adjacent portion of the main duct run and which branch duct run opens into the main duct run centrally intermediate the inlet end of the main duct run and the 90 degree turn therein.

Referring now more specifically to the FIG. 1, the numeral 10 generally designates a typical air handling duct system, the longest run of which is 100 feet.

The duct system includes a main duct run 12 including an inlet end 14 and an outlet end 16. The total length of the main duct run is 100 feet and includes a first section A extending from the inlet end 14 to a branch duct run 18 disposed at 90 degrees relative to the first section A.

The main duct run additionally includes a second section C coextensive with the first section A and the discharge end of the second section C terminates in a right angular section H which in turn terminates in a coextensive reduced dimension section I. The section I terminates in a coextensive final section K of the main duct run 12, the section K having a 45 degree turn L at the outlet end 16.

The branch duct run 18 includes a first inlet section B terminating in a coextensive reduced dimension section $E_1$ which in turn terminates in a coextensive further reduced cross section section G.

The discharge end of the first section B includes a short lateral section D terminating at an end outlet 1 and also includes a substantially flush outlet 2 at the opposite side of the first section B. The end of the section $E_1$ includes a 90 degree lateral duct section F opening outwardly thereof terminating at an end outlet 3 and the end of the section G terminates at an end outlet 4.

Further, the section H terminates at a lateral outlet 5 while the section I terminates at a lateral outlet 6 while the section K terminates at a 45 degree outlet 7.

The length of the first section A is 20 feet, the length of the section C is 20 feet, the length of the section H is 10 feet, the length of the section I is 15 feet and the length of the section K is 35 feet, the sections H, I and K totaling 60 feet in length and the sections and A and C totaling 40 feet in length. Thus, the length of the duct system from the inlet 14 from the outlet end 16 is 100 feet.

The length of the section B is 15 feet, the length of the section E is 25 feet and the length of the section G is 20 feet, the length of the combined sections B, $E_1$ and G being 60 feet, thus the outlet 4 being 80 feet from the inlet end 14.

Operably connected to the inlet end 14 is the outlet of a motorized fan F of pre-determined air volume capacity substantially equal to the total volume of air discharge of the outlets 1–7 and with a desired air velocity and static pressure (wherein all of the outlets may be plotted substantially on the RPM line on the associated fan curve) at a selected cross sectional discharge fitting 17 of the fan F coupled to the inlet end 14.

The total desired discharge of air for the outlets 1–7 is 1250 CFM, the outlet 1 being 200 CFM, the outlet 2 being 100 CFM, the 3 being 100 CFM, the outlet 4 being 500 CFM, the outlet 5 being 125 CFM, the outlet 6 being 75 CFM and the outlet 7 being 150 CFM.

Accordingly, 1250 CFM must flow through the duct section A and for the purpose of describing the operation of the duct system 10 we will assume that the duct section A has an interior cross sectional area of 1 $ft^2$.

In order to determine the proper sizes of the duct sections B, C, D, $E_1$, F, G, H, I and K as well as the cross sectional areas of the outlets 1–7, it will be noted that 900 CFM is the total volume of air to pass through the branch duct run 18. Accordingly, the section B must be properly sized in order not to incur additional frictional loss as a result of the 90 degree turn between section A and section B. In order to determine the proper cross sectional area of the section B, the step $$\sqrt{\frac{900\ \text{CFM}}{1250\ \text{CFM}}} \times \sqrt{\frac{180^\circ}{(180^\circ - 90^\circ)}}$$

is taken and the product is then multiplied by 1 $ft^2$, the cross sectional area of the duct section A. The product of these steps equals 1.199999 $ft^2$ (for 100 ft of duct length). Since the total length of sections A, B, $E_1$ and G is only 80 feet long, the product will have to be corrected for an 80 foot length of duct. This is accomplished by multiplying $$\sqrt{\frac{100\ \text{feet}}{80\ \text{feet}}} \times 900\ \text{CFM}.$$

The product of this operation equals 1006.2305 CFM for an 80 foot length of duct. However, this branch requires only 900 CFM and a further correction therefore must be made. In order to make this final correction the step $$\sqrt{\frac{900\ \text{CFM}}{1006.2305\ \text{CFM}}} \times 1.19999\ \text{ft}^2$$

is taken with the product equaling 1.1348897 $ft^2$, this being the internal cross sectional area of the duct section B. 350 CFM is the amount of air which the system 10 is designed to flow through the duct section C. To size the duct section C properly for the overall length of 100 feet, the step $$\sqrt{\frac{350\ \text{CFM}}{1250\ \text{CFM}}} \times 1\ \text{ft}^2$$

is taken in order to obtain the correct size of the duct section C or 0.5291502 $ft^2$.

Inasmuch as duct section H is disposed at 90 degrees relative to the duct section C, in order to size the duct section H so as to not to incur any addtional frictional loss due to the 90 degree turn, the cross sectional area (0.5291502) of the duct section C is multiplied by $$\sqrt{\frac{(180^\circ)}{(180^\circ - 90^\circ)}}.$$

This establishes the cross section area of the duct section H at 0.7483313 $ft^2$.

The next step is to properly size the outlet 1. Its design volume flow is 200 CFM and in order to properly size this duct run for a 80 foot length of duct, the cross sectional area of duct B (or 1.1348897 $ft^2$) is multiplied by $$\sqrt{\frac{(180°)}{(180° - 90°)}}$$

in order to obtain a first trial area of 1.604976406 $ft^2$. However, since only 200 CFM is to move through duct D, the cross sectional area thereof is adjusted by multiplying $$\sqrt{\frac{200\ CFM}{900\ CFM}} \times$$

the trial area 1.604976406 square feet or 0.0756593134 $ft^2$ for an 80 foot length of duct. However, since the duct length D is 4 feet, in order to adjust the cross sectional area of the duct D for a 39 foot length from the inlet end 14, the step $$\sqrt{\frac{80\ feet}{39\ feet}} \times 200\ CFM$$

is taken resulting in a product of 286.446 CFM for a 39 foot length of duct. In order to further adjust the cross sectional area for 200 CFM instead of 286.446 CFM, the step $$\sqrt{\frac{200\ CFM}{286.446\ CFM}} \times .0756593134$$

(or the second trial cross section area) is taken with the resultant product being 0.632219 $ft^2$, this being the final size for the outlet 1.

In order to determine the cross sectional area for the outlet 2, the step $$\sqrt{\frac{100\ CFM}{900\ CFM}} \times \text{the} \sqrt{\frac{(180°)}{(180° - 90°)}} \times 1.1348897$$

(the cross sectional area of duct section B) is taken with the product being 0.5349919 $ft^2$ cross sectional area for 100 CFM and a 80 foot length of duct. However, for a 35 foot length of duct from the inlet end 14 to the outlet 2, the step $$\sqrt{\frac{80\ feet}{35\ feet}} \times 100\ CFM$$

is taken in order to obtain a product of 151.185789204 CFM. Thereafter, in order to determine the final cross sectional area of the outlet 2, the step $$\sqrt{\frac{100\ CFM}{151.186\ CFM}} \times .535\ ft^2$$

is taken in order to determine the final cross sectional area of the outlet 2 at 0.4351084 $ft^2$.

In order to determine the cross section area of the section $E_1$, the step $$\sqrt{\frac{600\ CFM}{900\ CFM}} \times 1.348897\ ft^2$$

(the cross sectional area of the duct section B) is taken. The product establishes the cross sectional area of the duct section $E_1$ at 0.9266334 $ft^2$.

In order to determine the cross sectional area of the section F, the step $$\sqrt{\frac{100\ CFM}{600\ CFM}} \times \text{the} \sqrt{\frac{(180°)}{(180° - 90°)}}\ .926633560\ ft^2$$

is taken in order to obtain a first trial cross sectional area of 0.5349918 $ft^2$. However, this cross sectional area would be the size for the duct F if the distance between the inlet end 14 and outlet 3 was 80 feet in length. However, since outlet 3 is only 70 feet from the inlet end 14, the step $$\sqrt{\frac{80\ feet}{70\ feet}} \times 100\ CFM$$

is taken in order to obtain 106.900449 CFM. In order to adjust this product to 100 CFM, the step $$\sqrt{\frac{100\ CFM}{106.900449\ CFM}} \times .5349918\ ft^2$$

or 0.0517427 $ft^2$ the cross sectional area of the duct section F, the outlet 3 being of the same cross sectional area.

In order to obtain the cross sectional area of the duct section G, the step $$\sqrt{\frac{500\ CFM}{600\ CFM}} \times .926633560\ ft^2$$

(the cross area of the duct section $E_1$) is taken in order to obtain the product 0.8458966 $ft^2$ for the cross sectional area of the duct section G, the outlet 4 being of the same cross sectional area.

Outlet 5 is located 50 feet from the inlet 14. In order to obtain the cross sectional area of the outlet 5, the step $$\sqrt{\frac{125\ CFM}{350\ CFM}} \times \sqrt{\frac{(180°)}{(180° - 90°)}}\ .7483313$$

(the cross sectional area of duct section H) is taken. The product or 0.6324551 $ft^2$ is the cross sectional area for 125 CFM and a duct length of 100 feet. In order to correct this for the 50 foot length between the outlet 5 and the inlet end 14, the step $$\sqrt{\frac{100\ feet}{50\ feet}} \times 125\ CFM$$

is taken for a product of 176.78 CFM for a 50 foot length of duct. In order to correct this for 125 CFM, the step $$\sqrt{\frac{125\ \text{CFM}}{176.78\ \text{CFM}}} \times .6324551\ \text{ft}^2$$

for a final product of 0.5318243 $ft^2$, the cross sectional area of the outlet 5.

In order to determine the cross sectional area of duct section I, the step $$\sqrt{\frac{225\ \text{CFM}}{350\ \text{CFM}}} \times .7483313\ \text{ft}^2$$

is taken with the product being 0.599999858 $ft^2$, this being the cross sectional area of the duct section I.

In order to determine the cross sectional area of the outlet 6, it will be noted that outlet 6 is 65 feet away from the inlet end 14. Therefore, the step $$\sqrt{\frac{75\ \text{CFM}}{225\ \text{CFM}}} \times \text{the}\sqrt{\frac{(180^\circ)}{(180^\circ - 90^\circ)}}\ .59999858\ \text{ft}^2$$

0.59999858 $ft^2$ is taken to obtain the product 0.489897833 $ft^2$. In order to correct this for the 65 foot duct length between the inlet end 14 and the outlet 6, the step $$\sqrt{\frac{100\ \text{feet}}{65\ \text{feet}}} \times 75\ \text{CFM}$$

is taken in order to obtain the product 93 CFM. To correct 93 CFM for 75 CFM, the step $$\sqrt{\frac{75\ \text{CFM}}{93\ \text{CFM}}} \times .489897833\ \text{ft}^2$$

is taken with the product 0.4398796 $ft^2$ being the cross sectional area of the outlet 6.

In order now to determine the cross sectional area of the duct section K, the step $$\sqrt{\frac{150\ \text{CFM}}{225\ \text{CFM}}} \times .5999999$$

is taken with the product 0.489897833 $ft^2$ being the cross sectional area for the duct section K.

In order to determine the cross sectional area of the outlet 7, since the outlet 7 is 100 feet from the inlet end 14 but involves a 45 degree turn, the step $$\sqrt{\frac{(180^\circ)}{(180^\circ - 45^\circ)}} \times .4989897833\ \text{ft}^2$$

$ft^2$ is taken for a product of 0.5761837 $ft^2$, the cross sectional area of the outlet 7.

If other forms of resistance such as a return duct, coils, filters, sensors, automatic damper . . . etc., are added to the system, the sums of pressure increase must be converted into feet of duct length. This new superimposed length then is added to the inlet end of the supply duct thereof becoming the longest duct length.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. The method of constructing an air duct system for ventilating heating and/or air conditioning wherein the total length of the longest run of the duct system is predetermined and includes an inlet end, an outlet end, at least one included angle angular turn of at least 90 and less than 180 degrees between said inlet and outlet ends, at least one intermediate outlet of a desired flow volume intermediate said ends and at least one terminal outlet at said outlet end of a desired flow volume, and wherein said longest run comprises coextensive duct run segments extending between said inlet and outlet ends with each said intermediate and terminal outlets being disposed at the downstream end of a corresponding duct run segment, said method including providing a motorized fan having an air volume capacity substantially equal to the total volume of air discharge of said outlet with a desired air velocity and static pressure at a selected cross sectional area discharge fitting of said fan, providing an inlet duct run segment of said duct system having a cross sectional area of at least substantially said selected cross sectional area connecting a first inlet end of said inlet duct run segment to said discharge fitting, determining the desired flow volume of each said intermediate outlets and the flow volume of said terminal outlet with the total flow volume of said outlets substantially equaling said air volume capacity, providing a duct segment comprising the downstream leg of said angular turn with an inside cross sectional area substantially equal to the square root of 180 divided by, 180 minus the included angle of said angular turn, multiplied by substantially the inside cross sectional area of the upstream leg of said angular turn, connecting said duct segment comprising the downstream leg of said angular turn to the outlet end of said inlet duct run segment in a manner defining said included angle with said inlet duct run segment, forming each intermediate outlet, at each said intermediate outlet, comprising the downstream end of the immediate upstream duct run segment, downsizing the immediate downstream duct run segment from the last mentioned intermediate outlet by sizing said immediate downstream duct run segment to a cross sectional area substantially equal to the square root of the air flow volume immediately downstream from said last mentioned intermediate outlet divided by the air flow volume immediately upstream from said last mentioned intermediate outlet multiplied by the cross sectional area of said duct segment immediately upstream from said last mentioned intermediate outlet, determining a first trial cross sectional area of each said intermediate outlets to a first cross sectional area substantially equal to the square root of 180 divided by 180 minus the included angle of said intermediate outlet, multiplied by the cross sectional area of the immediate upstream duct segment from the last mentioned lateral outlet, determining a second trial cross sectional area of said intermediate outlet by multiplying substantially the square root of the desired air flow volume of said intermediate outlet divided by substantially the air flow volume in said duct segment immediately upstream from said intermediate outlet multiplied by substantially said first trial cross sectional area, determining a first trial air flow volume at said intermediate outlet by multiplying the square root of said total length divided by the length of said longest between said outlet end and said intermediate outlet multiplied by said desired air flow volume of said intermediate outlet, and determining the final cross sectional area of said intermediate outlet to a final cross sectional area substantially equal to the square root of the desired air flow volume of said intermediate outlet divided by said first trial air flow volume multiplied by said second trial cross sectional area and forming said intermediate outlet to a cross sectional area equal to said final cross sectional area.

2. The method of claim 1 wherein said terminal outlet comprises a laterally directed outlet, determining the cross sectional area of said terminal outlet to a selected cross sectional area substantially equal to the square root of 180 divided by, 180 minus the included angle of said laterally directed terminal outlet relative to the corresponding duct segment, multiplied by the cross sectional area of said corresponding duct segment.

3. The method of claim 1 wherein said one of said duct run segments terminates at a intermediate outlet comprising the inlet end of a branch run of said duct system including an outlet end and coextensive branch run segments extending between said last mentioned intermediate outlet and said branch run outlet end and including at least one intermediate outlet of a desired flow volume intermediate said branch run ends and at least one terminal outlet and wherein the length of said branch run is equal to less than the downstream length of said longest run from said last mentioned intermediate outlet, determining the desired flow volume of each said branch run intermediate outlets and the flow volume of said branch run terminal outlet with the total flow volume of said branch run outlet substantially equaling the air flow volume through said branch run inlet end segment, sizing said branch run inlet end segment to a first trial cross sectional area substantially equal to the square root of 180 divided by, 180 minus the included angle of said branch run inlet end segment, multiplied by substantially the cross sectional area of the branch duct run segment immediately upstream from said branch run inlet end segment, downsizing the last mentioned first trial cross sectional area to a second trial cross sectional area equal to the square root of the total air flow volume of said branch run outlets divided by the air flow volume in the longest run duct segment immediately upstream from said branch run inlet end multiplied by said branch run inlet end first trial cross sectional area, determining a phantom air flow volume for said branch run by multiplying the total flow volume of said branch run outlets by the square root of the total length of said longest run divided by the sum of the length of said branch run and the length of said longest run from said fitting to said branch run, determining the final cross sectional area of said branch run inlet end segment by multiplying the square root of the total air flow volume of said branch run outlets divided by said phantom air flow volume by the last mentioned second trial cross sectional area, determining the desired air flow volume of each said branch run intermediate outlets and the flow volume of said branch terminal end outlet with total flow volume of said branch run outlets substantially equaling the desired air flow volume through said branch run inlet end segment, sizing the cross sectional area of each said branch run intermediate outlets to a first trial cross sectional area substantially equal to the square root of 180 divided by, 180 minus the included angle of said branch run intermediate outlet, multiplied by the cross sectional area of the immediately upstream branch run duct segment from the last mentioned intermediate outlet, determining a second trial cross sectional area of the last mentioned intermediate outlet by multiplying substantially the square root of the desired air flow volume of the last mentioned intermediate outlet divided by substantially the air flow volume in said branch run duct segment immediately upstream from the last mentioned intermediate outlet multiplied by substantially the last mentioned first trial cross sectional area, determining a first trial air flow volume at the last mentioned branch run intermediate outlet by multiplying the square root of the sum of the length of said branch run and the length of said longest run between said fitting and said branch run divided by the length of said branch run between said branch run outlet end and the last mentioned intermediate outlet multiplied by said desired air flow volume of said branch run intermediate outlet, and finally sizing the cross sectional area of said last mentioned branch run intermediate outlet to a final cross sectional area substantially equal to the square root of the desired air flow volume of said last mentioned branch run intermediate outlet divided by the last mentioned phantom air flow volume multiplied by the last mentioned second trial cross sectional area, at each said last mentioned intermediate outlet, comprising the downstream end of the immediate upstream branch duct run segment, downsizing the immediate downstream branch duct run segment from the last mentioned intermediate outlet by sizing said immediate downstream branch run duct segment to a cross sectional area substantially equal to the square root of the air flow volume immediately downstream from said last mentioned intermediate outlet divided by the air flow volume immediately upstream from said last mentioned intermediate outlet multiplied by the cross sectional area of said duct segment immediately upstream from said last mentioned intermediate outlet.

4. The method of sizing the downstream leg of an angular turn of air handling duct system relative to the upstream leg at the angular turn, wherein said angular turn includes an predetermined included angle of at least 90 and less than 180 degrees, said method including providing an upstream duct leg of a first predetermined inside cross sectional area, providing a downstream duct leg of a second predetermined inside cross sectional area greater than said first predetermined cross sectional area and equal to the inside cross sectional are of the upstream leg multiplied by the square root of 180 divided by the included angle of the angular turn, and connecting said upstream and downstream legs in a manner defining said included angle between said upstream and downstream legs.

5. The method of downsizing a downstream duct segment of an air handling duct system relative to the immediate upstream duct segment of the system when a lateral outlet is disposed at the downstream end of the upstream segment, said method including providing an upstream duct segment of a first predetermined inside cross sectional area, having a lateral outlet of a second cross sectional area formed therein at the outlet end of said upstream duct segment and designed to have an air flow volume of a first predetermined rate flow therethrough, providing a downstream duct segment for coupling to the downstream end of said upstream segment and designed to have an air flow volume of a second predetermined rate flow therethrough with said downstream duct segment downsized relative to said upstream segment to a cross sectional area substantially equal to the square root of said second air flow volume divided by said first air flow volume through the upstream segment multiplied by said first cross sectional area, and connecting said downstream segment to said upstream segment in longitudinal alignment therewith.

* * * * *